United States Patent [19]

Leto et al.

[11] Patent Number: 4,648,964

[45] Date of Patent: Mar. 10, 1987

[54] SEPARATION OF HYDROCARBONS FROM TAR SANDS FROTH

[75] Inventors: Joseph J. Leto, Broomfield; Dennis D. Gertenbach, Golden; Daniel W. Gillespie, Wheatridge, all of Colo.

[73] Assignee: Resource Technology Associates, Boulder, Colo.

[21] Appl. No.: 771,204

[22] Filed: Aug. 30, 1985

[51] Int. Cl.[4] ..... C10G 1/04

[52] U.S. Cl. ..... 208/390; 208/391

[58] Field of Search ..... 208/11 LE, 8 LE, 13; 252/346, 347, 348

[56] References Cited

U.S. PATENT DOCUMENTS

| | | | |
|---|---|---|---|
| 895,229 | 8/1908 | Beddoes | 210/617 |
| 2,223,184 | 11/1950 | Pier et al. | 208/429 |
| 2,772,209 | 11/1956 | Stewart et al. | 208/145 |
| 2,789,083 | 4/1957 | Hardy | 208/390 |
| 2,809,153 | 10/1957 | Bacsik et al. | 208/6 |
| 2,864,502 | 12/1958 | May | 210/774 |
| 3,291,717 | 12/1966 | White | 208/390 |
| 3,331,765 | 7/1985 | Canevari et al. | 208/391 |
| 3,338,814 | 8/1967 | Given et al. | 208/425 |
| 3,401,110 | 9/1968 | Floyd et al. | 208/391 |
| 3,422,000 | 1/1969 | Bichard | 208/391 |
| 3,464,885 | 9/1969 | Land et al. | 166/17 |
| 3,606,731 | 9/1971 | Cole et al. | 55/45 |
| 3,606,999 | 9/1971 | Lawless | 423/659 |
| 3,607,721 | 9/1971 | Nagy | 208/390 |
| 3,684,699 | 8/1972 | Vermeulen et al. | 208/188 |
| 3,716,474 | 2/1973 | Hess et al. | 252/390 |
| 3,853,759 | 12/1974 | Titmas | 210/600 |
| 3,884,829 | 5/1975 | Moyer | 252/331 |
| 3,900,389 | 8/1975 | Baillie | 208/188 |
| 4,005,005 | 1/1977 | McCollum et al. | 208/390 |
| 4,158,638 | 6/1979 | Tsai | 208/391 |
| 4,192,731 | 3/1980 | Stearns et al. | 208/390 |
| 4,238,315 | 12/1980 | Patzer, II | 208/435 |
| 4,272,383 | 6/1981 | McGrew | 210/741 |
| 4,324,652 | 4/1982 | Hack | 209/3 |
| 4,358,373 | 11/1982 | Jubenville | 210/181 |
| 4,385,982 | 5/1983 | Anderson | 208/390 |
| 4,425,227 | 1/1984 | Smith | 209/5 |

FOREIGN PATENT DOCUMENTS

| | | | |
|---|---|---|---|
| 630710 | 11/1961 | Canada . | |
| 910271 | 9/1972 | Canada . | |
| 918091 | 1/1973 | Canada . | |
| 952837 | 8/1974 | Canada | 208/390 |
| 952839 | 8/1974 | Canada | 208/390 |

*Primary Examiner*—Asok Pal

*Attorney, Agent, or Firm*—Sheridan, Ross & McIntosh

[57] ABSTRACT

A process suitable for separating the hydrocarbon fraction from a tar sands froth is provided. The process comprises heating a fluid stream comprising the froth to above about 300° C., pressurizing the stream to above about 1000 psig and separating the hydrocarbon fraction, having less than 1 percent solids and less than 5 percent water, from the treated stream. Separation is preferably by gravitational settling in a settler and occurs substantially instantaneously. The heat/pressure treatment can be optionally followed by addition of a diluent, such as naphtha. The pressure is preferably produced by the hydrostatic head of a column of froth.

32 Claims, 5 Drawing Figures

SEPARATION OF HYDROCARBONS FROM TAR SANDS FROTH

FIELD OF THE INVENTION

This invention relates to a process for separating the hydrocarbon fraction from a tar sands froth and particularly to a separation process comprising heating and pressurizing a tar sands froth.

BACKGROUND OF THE INVENTION

A number of processes for recovery of bitumen from tar sands result in the formation of a hydrocarbon-water froth having an amount of finely divided solids dispersed therein. Typically, about 99 percent of the solids consists of quartz grains and clay minerals. The maximum sand grains size is about 1 mm diameter. About 99.9 percent of the mineral matter is finer than 100 microns (about −150 mesh).

One widespread tar sands treatment process is the so-called hot water extraction process. According to this process, a mined bitumen sand is sent to a conditioning drum. Caustic soda is added to adjust the pH to between about 7.5 to about 9.0. Steam is used to adjust the temperature to about 180° to 190° F. (82° to 88° C.) and make-up water is added to form a pulp having a solids content of about 70 percent. Oversized material is removed from this pulp by screening, and the screened pulp is sent to a flotation device. In the flotation device, the pulp is agitated to introduce air bubbles. Those components of the pulp which are least easily wetted are preferentially carried to the surface by the bubbles to form a froth. This froth is a fluid emulsion of water and hydrocarbons, such as bitumen. Non-hydrocarbon solids, such clay and sand, are typically dispersed in the fluid. The froth is separated from the bulk of the pulp. The so-called tar sands flotation froth which exits the flotation device typically contains about 40 to about 75 percent bitumen, about 10 to about 50 percent water and less than about 15 percent solids.

This froth is treated downstream by such processes as delayed or fluid coking, residual hydrocracking, or solvent deasphalting. In most cases, it is advantageous to decrease the water and/or solids content of the tar sands froth prior to such downstream processing.

A method for removing water and solids from tar sands froth which is commonly employed is centrifugation of the froth. Such methods are described in Evans et al. (Canadian Patent No. 918,091, 1973), Hall et al. (Canadian Patent No. 910,271, 1972) and Baillie (U.S. Pat. No. 3,900,389, 1975). Other hardware devices which have been proposed for solids removal include a hydrocyclone, as described by Given et al. (U.S. Pat. No. 3,338,814, 1967), an electrostatic desalter described by Anderson (U.S. Pat. No. 4,385,982, 1983) and an ultrasonic vibrator described by Jubenville (U.S. Pat. No. 4,358,373, 1982). One difficulty common to such hardware approaches is related to the fact that a solids-containing tar sands froth has a highly abrasive nature. Because of this, such hardware devices are relatively quickly rendered inoperable by attrition. Such devices are also relatively expensive to acquire, install and operate, particularly at field sites.

Other approaches to removal of water and solids from a tar sands froth have included chemical additions, ranging from a simple diluent addition such as that described by Nagey (U.S. Pat. No. 3,607,721, 1971), to more complicated chemical treatments such as those described by Canevari et al. (U.S. Pat. No. 3,331,765, 1967) and Moyer (U.S. Pat. No. 3,884,829, 1975). The cost of reagents has an effect on the economics of such processes. Even where some of the additives can be later recovered for recycle, a portion of the additives is typically degraded or otherwise lost to the recycle processes, particularly in processes which include treatment at elevated temperatures and/or pressure following addition of reagents. Furthermore, such processes involve a cost for transporting the additives to the treatment site which, in a tar sands froth application, is advantageously a field site.

A number of froth treatment processes involve the use of elevated temperatures or pressures during some portion of the treatment. Given et al. (U.S. Pat. No. 3,338,814, 1967) disclose a multi-step process for treating a bituminous emulsion, the first step of which involves a dehydration zone maintained at temperatures of from about 225° F. to about 550° F. (107° C. to 288° C.) and pressures of from about 4 psig to about 1000 psig in which vaporized water is removed from other constituents of the froth. Solids are separately removed downstream. May (U.S Pat. No. 2,864,502, 1958) discloses a multistage treatment for gas-oil-water emulsions including emulsion breaking under a pressure of 30 pounds.

Other heat/pressure treatment methods have been used to separate oil fractions in waste treatment processes. Cole et al. (U.S. Pat. No. 3,606,731, 1971) disclose that when the growth of algae in a water treatment facility or an API separator forms an algae-oil-water emulsion detrimental to water treatment processes, it is useful to coke the emulsion under autogenous pressure at elevated temperatures. In the feeds treated by Cole et al., the algae form an emulsifying agent. Cole et al. disclose heating the emulsion to coke the algae, thus substantially removing the emulsifying agent. Hess et al. (U.S. Pat. No. 3,716,474, 1973) disclose treating an oil-water sludge at a temperature of between about 750° F. and 850° F. (399° C. to 454° C.) at elevated pressures. In the examples disclosed in Hess et al., pressures of 3900 to 6150 psig were used. The Hess et al. process is directed to treatment of a sludge from a refinery disposal pit which typically contains emulsifying agents such as metallic salts and aromatic sulfonic acids. To remove metallic, particularly organometallic, contaminates, Hardy (U.S. Pat. No. 2,789,083, 1957) discloses treating a hydrocarbon oil, particularly gas oil or similar distillate oils, which involves subjecting an emulsion to a temperature above 500° F. and a pressure of about 100 to 500 psig.

A common difficulty with previous froth treatment methods is the necessity for construction of elaborate and expensive apparatus for performing these processes. This necessity makes the processes particularly unattractive for application to tar sands recovery which is most economically conducted when sand and other solids are separated from bitumen before incurring the cost of transport to treatment facilities. Furthermore, in treating tar sands froths, such apparatus is susceptible to abrasion from solids. Methods which require addition of reagents have proven uneconomical for many applications and particularly where recycle of reagents is prevented because of thermal degradation.

Previous methods produce only slight, if any, increases in settling rates. These methods are accompanied by gravity settling which is typically extended in time, and often must be augmented with centrifugation.

Accordingly, it is an object of this invention to provide a process for separating hydrocarbons from a tar sands froth which can be practiced in the field.

It is also an object of this invention to provide a tar sands froth hydrocarbon separation process that involves minimal consumption of energy, reagents and equipment.

It is a further object of this invention to provide a process for treating a stream comprising a tar sands froth which results in a substantially instantaneous gravitation separation the hydrocarbon fraction from the treated stream.

SUMMARY OF THE INVENTION

The present invention provides a process suitable for separating the hydrocarbon fraction from a tar sands froth. The process comprises heating a fluid stream comprising the froth to a treatment temperature above about 300° C., pressurizing the stream to a treatment pressure above about 1000 psig to produce a treated stream, and separating the hydrocarbon fraction from the treated stream.

Although the process of the present invention is particularly applicable to tar sands froths, the invention is generally applicable to any dispersion of solids in a fluid which contains hydrocarbons. As used herein, "hydrocarbon" is a compound or mixture of compounds containing carbon and hydrogen and can additionally contain other elements commonly present in organic and organometallic compounds such as oxygen, nitrogen, sulfur, phosphorus, and halogens and metals. The preferred hydrocarbon-containing fluid for this process is a tar sands froth produced by the hot water tar sands extraction process.

The invention comprises treatment at elevated temperatures and pressures to achieve separation of the hydrocarbon fraction from the remaining portions of the treated feed stream. The heat/pressure treatment renders the treated froth amenable to rapid phase separation so that the hydrocarbon fraction can be segregated by means of gravity settling, thickening, decantation, etc.

According to the process of the present invention, the froth is heated to above about 300° C. and subjected to a pressure of greater than about 1000 psig. The residence time of the froth at the elevated temperature and pressure depends upon such factors as the chemical composition of the hydrocarbon, the amount of coking that can be tolerated and the concentration of solids in the froth, but will generally be in the range of between about 1 and about 60 minutes, preferably between about 1 and about 15 minutes.

Following the pressure/heat treatment, the constituents of the froth are separated. The separation can be accomplished in a settler, by decantation or other similar means. A cooling step, including cooling by heat exchange with the untreated froth or by other cooling means, can precede the settling/separation. When applied to a tar sands froth, the process of the present invention has been found to result in substantially instantaneous separation of the hydrocarbon phase from the solids-containing water phase. In this context, "substantially instantaneous" settling means that after the heat/pressure treatment described more fully below, the treated froth, upon contact with a water layer, such as that typically present in a continuous-operation settler, will separate into hydrocarbon and water phases without the necessity for extended settling periods, i.e. in less than about 1 minute, and, typically, less than about 15 seconds.

It may be convenient or desirable to add a diluent following the heat/pressure treatment. Addition of a diluent is particularly advantageous when the hydrocarbon constituent of the froth is viscous, as a means for reducing viscosity and density of the hydrocarbon phase. Since the diluent can be added following the heat/pressure treatment and, preferably, following a cooling step, the diluent is not significantly degraded, evaporated or otherwise lost as might happen if the diluent were subjected to the elevated heat/pressure treatment of the present invention. All post-heat/pressure treatment steps are preferably conducted so as to minimize creation of turbulence or mixing or stirring the treated froth, so as to facilitate phase separation of the treated froth.

DESCRIPTION OF THE PREFERRED EMBODIMENTS

Figure 1:
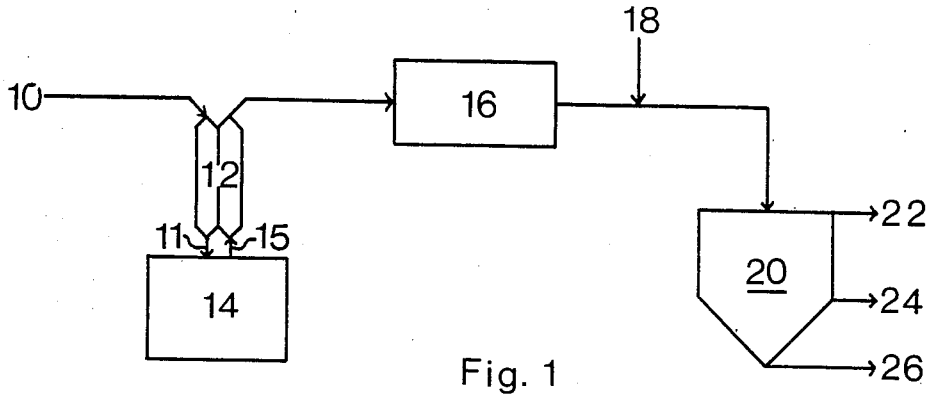
FIG. 1 is a schematic flow diagram of the preferred embodiment of the present invention.

The present invention relates to a process for separating solids from a hydrocarbon-containing fluid, particularly a tar sands froth, by subjecting the fluid to elevated temperatures and pressures for a period of time. Particularly contemplated for treatment by the process of the present invention are fluids which contain hydrocarbons such as bituminous material from tar sands, although the process has applications for fluids which contain other hydrocarbons such as petroleum and kerogen from oil shale. Thus, although the present invention may be practiced with any dispersion of solids in a hydrocarbon-containing fluid, it is particularly useful for treatment of a tar sands flotation froth. "Tar sands", as used herein, should be understood to include oil sands.

The tar sands froths treated by this procedure will typically be emulsions of water and hydrocarbons, with solids and gas entrained therein. Separation of the hydrocarbon fraction of those froths from water and from barren (non-hydrocarbon) solids is desirable in order to accomplish effective and economical refining of the hydrocarbons. A preferred feed is a raw froth, i.e. a froth substantially in the same condition as when it exits the froth flotation device, without any substantial intervening additions, or heat/pressure treatment. The raw froth may have been treated by such means as settling, in order to remove a first portion of easily separated water and/or solids. The preferred feed is substantially diluent-free, i.e., it has no substantial amount of a low-viscosity liquid miscible in the hydrocarbon fraction which is not present in the raw froth. A typical flotation froth will comprise from 10 to 50 weight percent water, 40 to 75 weight percent hydrocarbons and less than about 15 weight percent non-hydrocarbon solids.

The separation of the hydrocarbon fraction from a froth, according to the present invention, is not necessarily an absolute separation, in the sense that a certain amount of solids and/or water can be tolerated in the separated hydrocarbon fraction. The maximum concentration of solids which can be tolerated in the separated hydrocarbon fraction depends upon the downstream use or processing to which the hydrocarbon fraction will be subjected. When the hydrocarbon fraction is destined for a coker process, for example, the hydrocarbon fraction should contain less than about 1 weight percent solids, and less than about 5 weight percent water. Similarly, it is not necessary that the separated hydrocarbon fraction contain 100 percent of the hydrocarbons present in the froth. The separated hydrocarbon fraction preferably contains a substantial portion, typically greater than about 75 percent, of the total froth hydrocarbon content.

Tar sand froths which can be advantageously treated by the method of the present invention may include, besides water, hydrocarbon and clay and sand solids, other types of liquids such as dissolved alkali pH modifiers or detergents, gaseous components such as gaseous ammonia or $CO_2$, and matter derived from living material such as algae, bacteria, etc.

Referring now to FIG. 1, a feed stream 10 is provided to the process. As discussed above, the feed can be any hydrocarbon-containing fluid and preferably comprises a tar sands flotation froth comprising hydrocarbons, water and non-hydrocarbon solids such as clay or sand or a combination thereof. The stream 10 is conducted to a heat/pressure treatment zone 14 where it is subjected to elevated temperature and pressure. The product exiting the heat/pressure treatment zone 14 is a treated stream 15. The treated stream 15, at the point of leaving the heat/pressure treatment zone 14, can be unseparated, i.e. with solids and/or water still substantially dispersed with the hydrocarbon fraction, or the hydrocarbon fraction can be partially or fully separated from the other components of the treated stream. However, the treated stream 15 is in such a condition that if allowed to settle, the hydrocarbon phase separates from the treated stream at an enhanced rate, i.e. at a rate faster than the rate of separation of hydrocarbons from the untreated stream. When hydrocarbon-water phase separation is to be based on density differences, it is important that the hydrocarbon fraction of the treated stream 15 have a density less than water.

In order to assist in raising the bulk temperature of the feed stream 10 to the preferred treatment temperature described below, the stream is preferably passed through a heat exchanger 12 to recover heat from the outgoing heat/pressure treated stream 15. The heat exchanger 12 can be of a number of designs suitable for transfer of heat between fluids, including a design which involves juxtaposition of a conduit carrying the untreated incoming fluid stream 11 and a conduit carrying heat/pressure treated stream 15.

The stream which has been optionally heated in the heat exchanger 12 is subjected to a heat/pressure treatment comprising heating the stream to a treatment temperature above about 300° C., and pressurizing the stream to a treatment pressure above about 1000 psig. By "heating and pressurizing" the stream it is meant that any given macroscale volume or "parcel" of the fluid stream is subjected to an elevated bulk temperature and pressure. Although, in the preferred embodiment, heating, pressurizing and separating are conducted in a continuous flow process, the process of the invention can also be conducted by treating the stream in a discontinuous or batch mode. The stream is preferably maintained at the treatment temperature and pressure for a time between about 1 and about 60 minutes to produce a treated stream.

A variety of apparatus can be used in the heat/pressure treatment step of the present invention including autoclaves and tubular reactors. Apparatus, such as high pressure pumps, for achieving elevated pressures is typically elaborate and expensive. Hess et al. (U.S. Pat. No. 3,716,474, 1973) disclose high pressure pumps connected to an insulated pressure vessel. Such pumps would be quickly abraded by the solids present in tar sands froth if the method of Hess et al. was employed to achieve pressurization of the feed. The examples in Cole et al. (U.S. Pat. No. 3,606,731, 1971) disclose using an autoclave to achieve pressurization. Because of the abrasive nature of solids-containing tar sands froth, the apparatus disclosed in Cole et al. and Hess et al. would be subject to operational difficulties and high maintenance costs.

In the preferred embodiment of the present invention, the heat/pressure treatment is conducted in a vertical tube reactor. In this fashion, the fluid pressure can be substantially continuously increased to the desired level. In such a reactor, at least part of the pressure is provided by the hydrostatic head of the feed stream. In such a reactor, the heat exchange step previously described can be conveniently accomplished by arranging downcomer and riser tubes adjacent to one another or concentric to one another. A vertical tube reactor is inexpensive to install and operate, compared to previous froth separation apparatus, and can be installed at field sites, for example near tar sands extraction operations. Vertical tube reactors are capable of continuous operation and do not require the types of high pressure pumps and valves used by previous methods for treating mixtures of hydrocarbons, water and/or solids. Vertical tube reactors are not greatly susceptible to the breakdowns and maintenance costs associated with high pressure pumps and valves which would be quickly abraded by the solids present in a tar sands froth.

Methods of producing pressure in a continuous manner by hydraulic or hydrostatic systems have been disclosed for applications other than separation of hydrocarbons from froths. Titmus (U.S. Pat. No. 3,853,759, 1974) and McGrew (U.S. Pat. 4,272,383, 1981) disclose hydrostatic pressure developed in a vertical tube reactor to be particularly useful in treating sewage. Land (U.S. Pat. No. 3,464,885, 1969) discloses treatment of wood chips in a vertical tube reactor. Lawless (U.S. Pat. No. 3,606,999, 1967) is particularly directed to liquid-gas reactions in a vertical tube reactor, including chlorination, oxidation or hydrogenation of oil sands. Lawless, however, does not discuss hydrocarbon separation.

In the preferred embodiment, a vertical tube reactor for separating hydrocarbons from a tar sands froth comprises substantially concentric downcomer and riser conduits of sufficient height that a column of froth in the downcomer conduit produces a hydrostatic pressure at the bottom of the column of at least about 1000 psig. The process of this embodiment comprises continuously flowing the froth down the downcomer conduit and up the riser conduit. The downcomer and riser flows are preferably in heat exchange relationship. The flow rate of the stream is such as to maintain the stream at a treatment pressure above about 1000 psig for between about 1 minute and about 60 minutes. While the stream is at least at the treatment pressure, it is heated to a treatment temperature above about 300° C. The treated stream which exits the riser conduit, is gravitationally settled to separate the hydrocarbon fraction.

Temperatures greater than the minimum temperature of 300° C. and pressures greater than the minimum pressure of about 1000 psig may be employed according to the process of this invention. Such increased temperatures and pressures will, for some types of feeds, such as those comprising particularly viscous hydrocarbons or those with a high solids content, produce a higher degree of separation or produce a separation in a shorter amount of time than less severe conditions. For example, if the separation step includes a filtration process, it is preferred to conduct the heat/pressure treatment at temperatures and pressures, and for a time sufficient to produce a treated stream filtration rate of more than 30 gallons/ft$^2$/hour.

In many applications it will be desirable to avoid temperatures and/or pressures which are sufficiently elevated to produce certain chemical changes in the constituents of the fluid. In particular, it is often desired to avoid or minimize coking of the hydrocarbon constituents as, for example, when the fluid comprises a tar sands froth and coking of the hydrocarbon values of the froth is to be avoided. Coking is particularly to be avoided or minimized when the reactor is a vertical tube reactor. When the feed stream comprises a tar sands froth flotation emulsion, it is preferred to conduct the process at temperatures less than about 450° C. and preferably less than 415° C. and at pressures less than about 3700 psig, preferably less than about 3400 psig, most preferably less than about 3000 psig.

Although avoidance of coking places some limitations on the maximum treatment temperature and pressure for particular applications, some advantages, such as enhanced rate or effectiveness of separation, can be obtained from employing treatment temperatures above the minimum temperature of about 300° C. and/or treatment pressures above the minimum pressure of about 1000 psig. In general, it is desirable to accompany an increase in the treatment temperature and pressure above the minimum treatment temperature and pressure with a decrease in the residence time, i.e. the time for which the stream is maintained above the treatment temperature and pressure, particularly when it is desired to avoid coking. In particular, when conducting the process at a treatment temperature above about 400° C. and/or a treatment pressure above about 2100 psig it is preferred to limit the residence time to less than about 30 minutes and most preferably to less than about 15 minutes.

The pressure created in the heat/pressure treatment zone 14 can be at least partially adjusted by adding water or by otherwise adjusting the amount of water present in the stream 10. All other factors being equal, an increase in the weight percent of water in the stream will, in general, increase the pressure achieved in the heat/pressure treatment zone 14 by producing a larger amount of steam during the treatment.

After the heat/pressure treatment, the treated stream is in condition for gravity separation of the hydrocarbons from the other constituents. Optionally, separation can be preceded by steps which can assist in handling or further augment the rate or degree of separation achieved, such as treatment in a cooling device 16 or addition of diluent 18. However, regardless of the presence or absence of additional operations and regardless of the type of separation employed, it is advantageous to perform all steps subsequent to treatment in the heat/pressure treatment zone 14 in a manner which minimizes mixing of the treated stream. Rough handling of the treated stream which results in substantial mixing adversely affects the speed and completeness of separation. Mixing can be minimized by such measures as reducing turbulence of the flow, for example, as by designing the post-heat/pressure treatment flow so that the treated stream is conducted to the separating step in a substantially laminar flow mode, or by avoiding vigorous agitation or overturning until after the desired separation of constituents has occurred.

Post-heat/pressure treatment handling is rendered more convenient by cooling the treated stream prior to the separation step. By such cooling, it becomes possible to avoid vaporization of constituents of the treated stream without the necessity to maintain substantially superatmospheric pressures. Thus, treatment in a cooling device is particularly an advantage when post-heat/pressure treatment steps will be performed at atmospheric pressure, such as gravity separation in settling vessels. As discussed above, it is preferred to perform at least part of the cooling of the treated stream in a heat exchanger 12 so as to conserve the energy supplied in the heat/pressure treatment zone 14. Alternatively or additionally, cooling of the treated stream can be accomplished by such devices as conventional tube and shell heat exchangers or air-cooled heat exchangers.

Speed and/or effectiveness of the separation step can be optionally enhanced by addition of diluent 18. The useful diluent is a liquid soluble in the hydrocarbon which, when mixed with the hydrocarbon, produces a mixture with a lower viscosity and lower density than the undiluted hydrocarbon. The diluent is preferably a light hydrocarbon or a mixture of hydrocarbons boiling below about 250° C., and most preferably is naphtha, particularly when the stream 10 is a tar sands froth emulsion. The preferred amount of naphtha added is such as to produce a naphtha to treated stream weight ratio of between about 0.5 and 1, preferably between about 0.75 and 1. When the process also includes a cooling step, the diluent addition 18 can precede or follow the cooling device 16. It is preferred to add diluent after the treated stream has been cooled sufficiently to avoid thermal degradation or vaporization of the diluent. In an embodiment wherein naphtha is added, it is preferred to add the naphtha while the treated stream feed is at a temperature above about 80° C. Other diluents usable with the process of the present invention include heavy condensate and light kerosene.

Diluent addition is particularly useful when the hydrocarbon fraction of the stream is especially viscous. However, even in these cases the process of the present invention can be practiced without any addition of diluent to the treated stream. Fluids with viscous hydrocarbons can be effectively treated by utilizing more severe process conditions, i.e. higher than minimum treatment temperatures and/or pressures or longer residence times than those effective for less viscous hydrocarbons.

The hydrocarbon fraction of the treated stream can be separated by a number of means including gravity settling, filtration, decantation, etc. Gravity settling may be accomplished by a settling vessel 20 in FIG. 1.

The separation process is conducted for a period sufficient to obtain the desired degree of separation. The amount of separation required will, of course, depend upon the intended use of the hydrocarbon fraction. When, for instance, the hydrocarbon fraction is to be subjected to a coking process, it is preferred that the separation proceed to a point resulting in a hydrocarbon fraction with a solids concentration less than 1 weight percent and preferably less than 0.5 weight percent and, preferably, a water concentration less than 5 weight percent.

When the feed comprises a tar sands froth comprising water and solids, settling produces a hydrocarbon phase and a water phase. Substantially all non-hydrocarbon solids are dispersed in the water phase. Typically, less than 10 percent by weight and more preferably less than 5 percent by weight of the solids originally present in the froth are dispersed in the separated hydrocarbon phase.

Particularly rapid and effective solids separation has been noticed in cases when the process of this invention was applied to a tar sands froth comprising clay solids. Without intending to be bound by any theory, it is postulated that separation of solids from the hydrocarbon fraction is assisted by a process wherein the elevated heat/pressure treatment renders some types of solids, particularly clay solids, hydrophillic so that upon separation of the hydrocarbon and water phases, the solids will preferentially be dispersed in the water phase. In some cases it may be desirable to add water to the froth prior to the heat/pressure treatment to facilitate the solids removal.

It has been found that when a tar sands froth is subjected to the heat/pressure treatment described above, the treated froth separates into hydrocarbon and water phases substantially instantaneously. Since the solids contained in the froth are preferentially dispersed in the water phase, solids separation is thus also substantially instantaneous.

When the desired degree of separation has been achieved, the separated constituents such as the hydrocarbon phase 24 and the solids, possibly dispersed in a water phase 26, are directed to their ultimate destination. For example, the hydrocarbon fraction 24 can be sent to a refining operation such as a cracking or coking operation. The water and solids fraction 26 may be further treated to separate the water from the solids, or to eliminate contaminants from this fraction so as to allow for environmentally acceptable disposal or for recycle to another step of the operation such as a froth flotation step.

It has been found that when a hydrocarbonaceous feed is treated according to the process of the present invention, a certain amount of the 950° F.+ residual fraction is converted to lower boiling materials. Other changes in the character of the hydrocarbons as a result of the present process include changes in the amount of Conradson Carbon present in the hydrocarbon and a certain amount of gas make. When the treated stream contains a substantial amount of gaseous material, such material can be vented by vent 22 from the settler 20 as it evolves.

Figure 2:
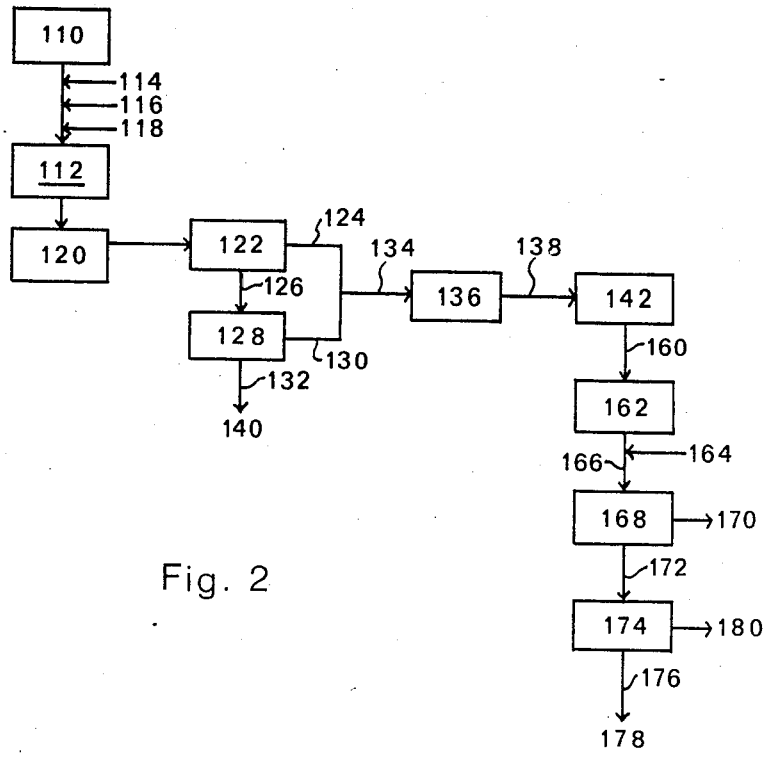
FIG. 2 is a schematic flow diagram of the preferred process of the present invention applied to a tar sands extraction operation.

In a preferred embodiment, the solids separation process of this invention is applied to the froth from a tar sands hot water extraction process. Referring now to FIG. 2, tar sands 110 which have been mined from a tar sands deposit are forwarded to a conditioning drum 112. Caustic soda 114 is added to raise the pH to between 7.5 and 9.0. Steam 116 is added to raise the temperature to between 180° and 190° F. (82° to 88° C.). Sufficient make-up water 118 is added to adjust the solids content to about 70 percent. The conditioned pulp is sent to a screening apparatus 120 which removes oversized material. The screened pulp is subjected to a primary froth flotation 122 to produce a primary froth 124 and a primary tailings 126. The primary tailings 126 is sent to a secondary "scavenger" froth flotation device 128 to produce scavenger froth 130 and scavenger tailings 132. The scavenger tailings 132 are sent to disposal 140. The primary froth 124 and scavenger froth 130 are combined to produce a froth feed 134. The froth feed 134 is heated in heating zone 136. Heated froth 138 is directed to a heat/pressure treatment zone 142, in which the froth is heated to above about 300° C. and pressurized to above about 1000 psig. Preferably, the pressure is produced by the hydrostatic head of a column of the froth.

The treated stream 160 is directed to a cooling step 162 to bring the temperature of the treated stream to about 80° C. Naphtha 164 is added in a naphtha to treated stream weight ratio of between about 0.5 and 1. The mixed stream 166 is directed to a gravity settler 168 where the treated stream separates in a continuous stream process. Within the gravity settler 168, the stream 166 is contacted with a layer of water comprising a previously separated water fraction of tar sands froth whereby said treated froth gravitationally separates into a hydrocarbon fraction 170 and a solids-containing water fraction 172. The hydrocarbon fraction 170 is continuously removed while a portion of the water fraction 172 is continuously bled off. The water fraction 172 is directed to a settling apparatus 174 for separation of the solids 176 for disposal 178. The substantially clarified water fraction 180 may be disposed of or may be treated to place it in condition for recycle to, for example, the conditioning step 112.

The following examples are provided by way of illustration and not by way of limitation.

EXAMPLE 1

Two flotation froth products were obtained from a tar sands extraction operation. The compositions of these products is shown in Table 1A. Tests 1–3 used froth #1 as the feed and tests 4–9 used froth #2 as the feed. Froth #1 had a 63.3 weight percent bitumen content and froth #2 had a 65.1 weight percent bitumen content. In each test, the product was added to a rocking bomb autoclave. After purging air from the system, the autoclave was slowly brought to the reaction temperature and pressure set forth in Table 1A in about 2 hours with constant rocking. After treating the mixture for a specified time (residence time), the contents were allowed to cool overnight with the rocker in motion. After treatment, the product was diluted with naphtha in a 1:1 ratio and the mixture was settled at 80° C. using a separatory funnel. Results are presented in Table 1B. Solids content of the separated hydrocarbon fraction was less than the feed solids content in every test. The variability of the settling characteristics of the froth product appears to be due to the processing steps performed on the froth after thermal treatment. Vigorous agitation at elevated temperatures emulsified the processed froth, encapsulating solids in the oil phase.

An analysis of the 950° F.+ (510° C.+) residual conversion and Conradson Carbon content of the hydrocarbon fraction produced by tests 2, 3, 6 and 8 was conducted. Results are presented in Table 1B. The froth feeds and the product of tests 3 and 8 were subjected to coking at 500° C. in a laboratory-scale coker. Yields from the laboratory scale coker for these tests are presented in Table 1C.

Figure 3:
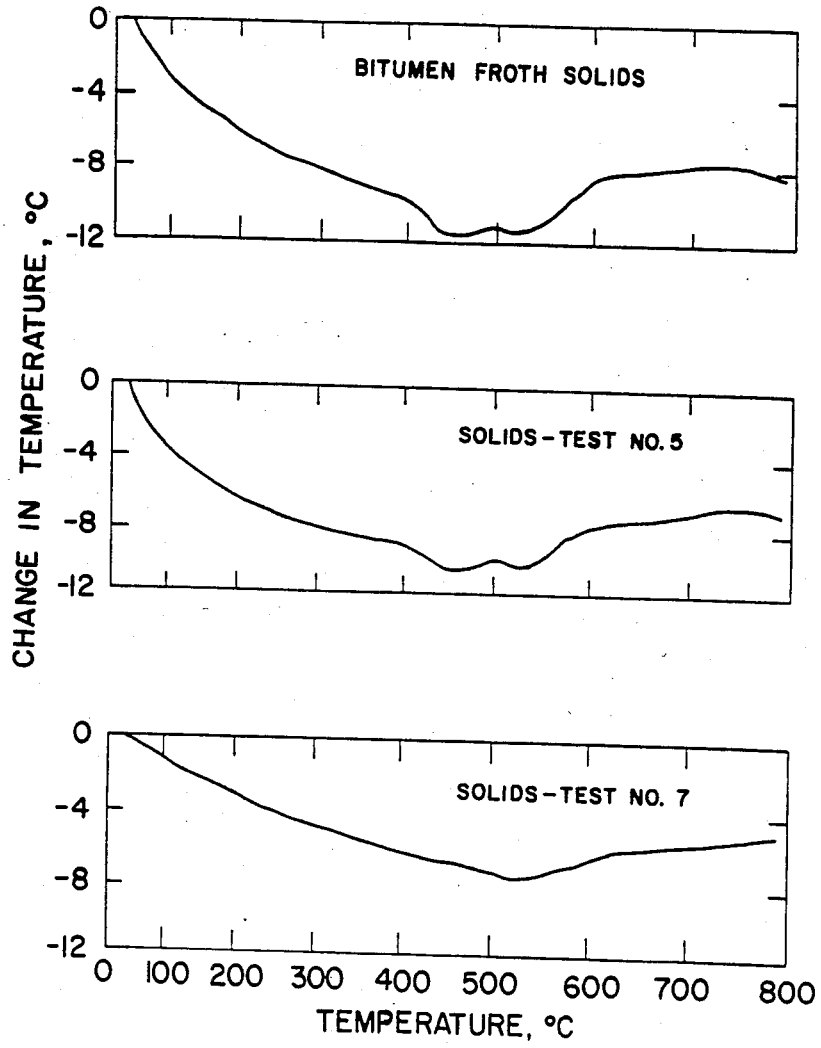
FIGS. 3 and 4 are diagrams of differential thermal analyses of froth solids from autoclave tests.

Differential thermal analyses (DTA) of the product solids from tests 5 and 7 and from untreated froth were performed at a heating rate of 20° C. per minute in nitrogen. The results are shown in FIG. 3. As can be seen, the clays in the unprocessed froth begin to lose water of hydration at about 400° C. Test 5 gave a similar DTA curve, and had poor settling and filtration characteristics. In test 7, the clay solids were partially dehydrated as shown by a lack of a DTA peak at 400° C. This test showed good settling and filtration, suggesting that the clays in the bitumen are made hydrophillic with thermal treatment due to the loss of water in the clays at 400° C.

A particle size distribution analysis was conducted for the solids from froth #2. The results are presented in Table 1D.

TABLE 1D

| Froth #2 Particle Size Distribution | | |
|---|---|---|
| mesh | micron | wt % |
| plus 100 | plus 149 | 0.8 |
| 100 by 200 | 149 by 74 | 11.8 |
| 200 by 325 | 74 by 44 | 20.2 |
| minus 325 | minus 44 | 67.2 |

EXAMPLE 2

A second series of rocking bomb autoclave tests was made on flotation froth No. 2. The autoclaving procedure was the same as that described for Example 1. Care was taken with the autoclave product to prevent agitation which would result in the formation of a solids-containing emulsion. The treated froth was removed from the autoclave at 80° C., gently mixed with naphtha, and placed in a 4 inch diameter gravity settler. Hot water had previously been added to the settler to simulate continuous operation. The processing conditions and results for these tests are presented in Table 2A. For comparison, analysis is also given in Table 2A for froth which was diluted and settled, but not subjected to a heat/pressure treatment. Solids content of the hydrocarbon fraction was consistently less than the solids content of either the feed or diluted but untreated froth.

An analysis of the 950° F.+ (510° C.+) residual conversion and the Conradson Carbon content of the oil fraction produced by some of these tests was conducted. Results are presented in Table 2B. The product of tests 11, 12 and 16 were subjected to coking at 500° C. in a laboratory-scale coker. Yields for these tests are presented in Table 2B.

Figure 4:
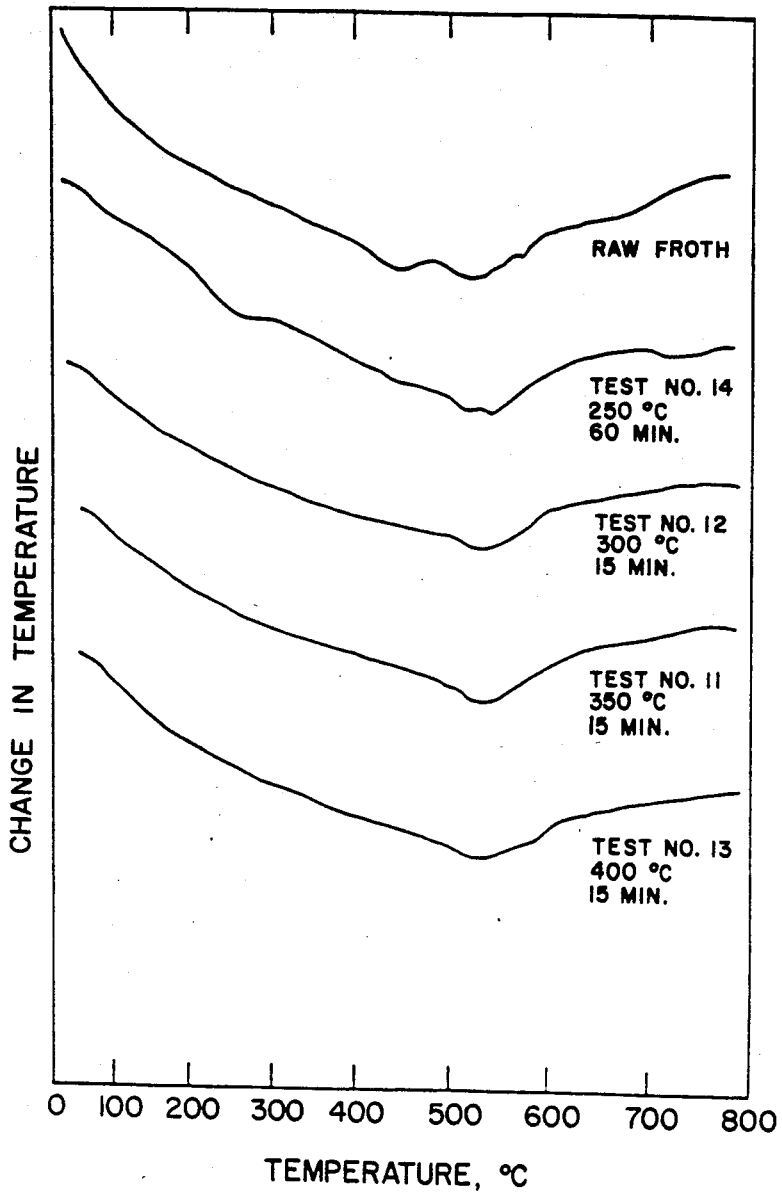

Differential thermal analyses (DTA) were performed on solids from tests 11 through 14 at a heating rate of 20° C. per minute in nitrogen. The results are shown in FIG. 4. These curves show that the solids drastically change with increasing processing temperature and residence time. The solids from the raw froth shows to large endotherms at 450° and 550° C. At processing temperatures of 250° to 300° C., the first of these endotherm nearly disappeared. Above 300° C., the first endotherm vanished.

TABLE 1A

| Froth Treatment Tests for Removal of Water and Solids | | | | | | | | | | |
|---|---|---|---|---|---|---|---|---|---|---|
| | Conditions | | | | Solids (wt. %) | | Water (wt. %) | | Asphaltenes (wt. %) | |
| Test No. | Residence Time Minutes | Temp. °C. | Start Pressure psig | End Pressure Feed | Untreated Fraction | Separated Hydrocarbon Fraction | Untreated Feed | Separated Hydrocarbon Fraction | Untreated Feed | Separated Hydrocarbon Fraction |
| 1 | 60 | 350 | 2250 | 2250 | 3.1 | 1.7 | 33.6 | 15.0 | 16.6 | 13.3 |
| 2 | 15 | 400 | 2250 | 2275 | 3.1 | 0.5 | 26 | 2.1 | 16.6 | 12.3 |
| 3 | 60 | 400 | 1800 | 2000 | 3.1 | 1.5 | 21 | 0.7 | 16.6 | 12.5 |
| 4 | 60 | 400 | 1350 | 1550 | 7.9 | 4.4 | 10 | 6.7 | 15.7 | 15.3 |
| 5 | 60 | 400 | 1700 | 1700 | 7.9 | 6.9 | 27 | 4.8 | 15.7 | 14.4 |
| 6 | 60 | 400 | 2600 | 2700 | 7.9 | 4.3 | 27 | 27.1 | 15.7 | 8.7 |
| 7 | 15 | 400 | 2600 | 2670 | 7.9 | 4.0 | 27 | 20.2 | 15.7 | 13.5 |
| 8 | 0 | 400 | 2650 | 2650 | 7.9 | 5.9 | 27 | 24.5 | 15.7 | 14.0 |
| 9 | 15 | 425 | 3100 | 3100 | 7.9 | 2.5 | 27 | 31.3 | 15.7 | 22.9 |

TABLE 1B

| Conradson Carbons of Oil Fractions | | | | |
|---|---|---|---|---|
| Test No. | Residual Conversion in Treatment Weight % | Direct Con Carbon, of Whole Oil Weight % | Con Carbon of, 950° F.+, Weight % | Calculated Whole Oil Con Carbon, from 950° F.+ Data, Wt % |
| feed | 0 | 13.0 ± 0.2 | 19.3 | 13.4 |
| 2 | 15.5 | 11.5 | — | — |
| 3 | −2.6 | 18.4 | 28.9 | 20.6 |
| 6 | 30.6 | — | 30.3 | 14.7 |
| 8 | 9.6 | 14.1 | 17.4 | 11.0 |

TABLE 1C

| Laboratory Scale Coker Yields | | | | | | |
|---|---|---|---|---|---|---|
| Test | Residual Basis | | | Whole Oil Basis | | |
| Number | Coke | Oil | Gas | Coke | Oil | Gas |
| Froth #1 | 19.4 | 68.8 | 11.8 | 12.1 | 80.5 | 7.4 |
| 3 | 24.2 | 65.2 | 10.6 | 17.3 | 75.1 | 7.6 |
| Froth #2 | 17.2 | 69.8 | 13.0 | 12.0 | 78.9 | 9.1 |
| 8 | 17.5 | 70.1 | 12.4 | 11.0 | 81.2 | 7.8 |

TABLE 2A

| Froth Treatment Batch Autoclave Tests | | | | | | | | |
|---|---|---|---|---|---|---|---|---|
| | Reaction Conditions | | | Dilution | | Product | | |
| Test | | pressure | | (Naphtha/Froth | Hydrocarbon Loss | Oil Analysis[1] | | % Solids |
| No. | Temp, °C. | psig | Time, min | Wt/Wt | (Wt % of Total) | % Water | % Solids | Removed |
| Froth No. 2 | — | — | — | 1:1 | 1.2 | 2.1 | 1.74 | 87.2 |
| 10 | 400 | 2900 | 15 | 1:1 | 1.9 | 0.1 | 0.38 | 99.7 |
| 11 | 350 | 2150 | 15 | 1:1 | 0.7 | 0.4 | 2.27 | 98.3 |

TABLE 2A-continued

| Test No. | Reaction Conditions Temp, °C. | pressure psig | Time, min | Dilution (Naphtha/Froth Wt/Wt | Hydrocarbon Loss (Wt % of Total) | Product Oil Analysis[1] % Water | % Solids | % Solids Removed |
|---|---|---|---|---|---|---|---|---|
| 12 | 300 | 1460 | 15 | 1:1 | 0.6 | 0.1 | 1.98 | 98.2 |
| 13 | 400 | 2850 | 15 | 0.5:1 | 2.9 | 0.4 | 1.30 | 98.8 |
| 14 | 250 | 770 | 60 | 1:1 | 3.0 | 0.2 | 0.64 | 91.2 |
| 15 | 400 | 3000 | 0 | 0.5:1 | 4.8 | 0.7 | 0.40 | 98.9 |
| 16[2] | 400 | 3300 | 15 | 0.5:1 | 1.7 | | 0.15 | 98.1 |
| 17[2] | 400 | 3710 | 15 | 0.5:1 | | | | |

[1]Analysis includes naphtha.
[2]The products of tests 16 and 17 were combined for analysis.

TABLE 2B

| Test No. | Residual Conversion in Treatment Weight % | Direct Con Carbon, of Whole Oil Weight % | Con Carbon of, 950° F.+, Weight % | Calculated Whole Oil Con Carbon, from 950° F.+ Data, Wt % |
|---|---|---|---|---|
| 10 | 14.3 | 12.9 | 28.2 | 16.9 |
| 11 | −13.0 | 14.0 | 18.1 | 14.1 |
| 12 | 0.0 | 13.5 | 20.5 | 14.3 |
| 16/17[1] | 21.6 | 12.4 | 23.9 | 13.0 |

[1]The products of tests 16 and 17 were combined for analysis.

TABLE 2C

| Test Number | Residual Basis Coke | Oil | Gas | Whole Oil Basis Coke | Oil | Gas |
|---|---|---|---|---|---|---|
| Froth #2 | 17.2 | 69.8 | 13.0 | 12.0 | 78.9 | 9.1 |
| 11 | 15.8 | 71.4 | 12.8 | 12.4 | 77.5 | 10.1 |
| 12 | 17.7 | 71.4 | 10.9 | 12.5 | 80.0 | 7.6 |
| 16/17[1] | 20.3 | 71.6 | 8.1 | 11.1 | 84.5 | 4.4 |

[1]The products of tests 16 and 17 were combined for analysis.

EXAMPLE 3

In order to test the procedure for heating and cooling times shorter than those possible with the rocking bomb autoclave, a series of tests was made in one-half inch inside diameter tubes heated by a fluidized sand bed. The tubes were filled half full with froth No. 2 and were sealed. The tubes were immersed in the hot fluid bed, and brought to the treatment temperature in about 3 minutes. The tubes were maintained at the treatment temperatures and pressures for the residence times indicated in Table 3. After this residence time, the tubes were quenched in water to achieve a cooling time of about two minutes. Following the quenching naphtha was added to the product, and the mixture was heated to 80° C. The water and solids were separated in a separatory funnel which contained additional water. The solids content of the hydrocarbon was determined by washing with benzene. The reaction conditions and results for these tests are presented in Table 3. Pressure was calculated from the treatment temperature, tube volume and fluid volume.

Figure 5:
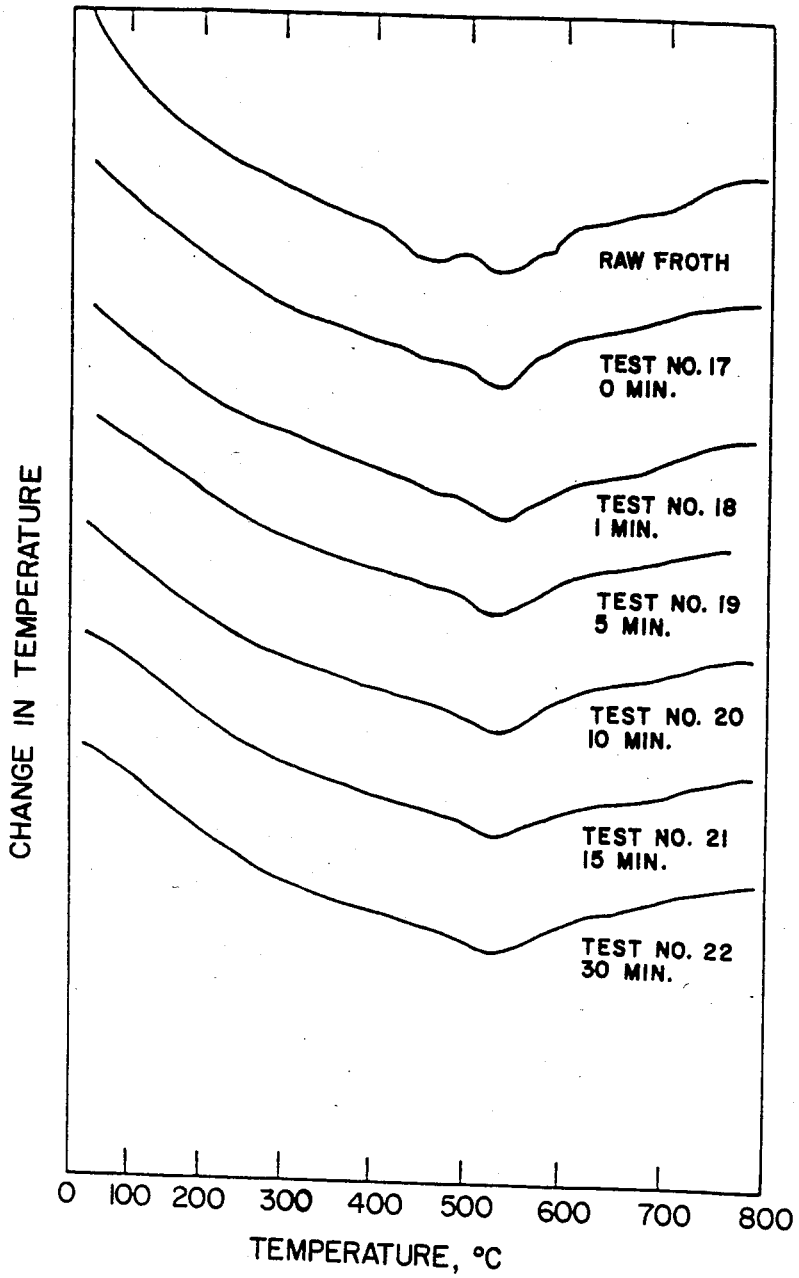
FIG. 5 is a diagram of differential thermal analyses of froth solids from microtube tests.

Differential thermal analyses (DTA) were performed on solids from the micro-tube tests at a heating rate of 20° C. per minute in nitrogen. The results are shown in FIG. 5. The raw froth DTA curve shows two large endotherms at 450° and 500° C. The first endotherm disappears at a residence time of 5 minutes or greater. These curves suggest that the solids become hydrophillic due to the evolution of water from the clay minerals in the solids.

TABLE 3

Froth Treatment Micro-Tube Tests
Froth #2, Initial Solids: 7.9%

| Test No. | Temp. °C. | Press. psig (±200 psig) | Time (Minutes) | Sample Weight, grams | Naphtha Weight, grams | % Solids in HC |
|---|---|---|---|---|---|---|
| 18 | 400 | 3500 | 0 | 10.04 | 10.03 | 1.25 |
| 19 | 400 | 3500 | 1 | 10.51 | 8.48 | 0.99 |
| 20 | 400 | 3500 | 5 | 10.59 | 7.01 | 0.75 |
| 21 | 400 | 3500 | 10 | 10.66 | 7.22 | 0.97 |
| 22 | 400 | 3500 | 15 | 10.18 | 8.30 | 0.64 |
| 23 | 400 | 3500 | 30 | 11.07 | 7.06 | 1.28 |

EXAMPLE 4

An oil-water-solids emulsion was prepared by mixing a heavy oil from the Cold Lake area with water. In tests RBT 2 and RBT 3, −200 mesh silica sand was added to this mixture. In tests RBT 4 and RBT 5, solids containing clays previously derived from a froth flotation product and with the size distribution shown in Table 1D were added. The heat-pressure treatment was performed in the manner described in Example 1. After cooling to 80° C., the product was removed. In these tests, there was no addition of naphtha to the product Hot (about 90° C.) water was placed in a settler and the hot oil mixture was slowly poured on the water. The settler rake was turned on gently agitating the contents of the separator. The solids and water separated from the oil, with the solids dropping to the bottom of the separator, and the water mixing into the aqueous phase. After 30 minutes, the three phases were collected separately. The solids and water content of the underflow and overflow phases were analyzed The test conditions and results are presented in Table 4. Settler overflow had a solids content consistently less than that of the feed.

TABLE 4

Separation of Solids-Oil-Water Mixtures

| Test | Solid | Temp °C. | Press psi | Time min | Feed Analysis, % Oil | Water | Solids | Product | Product Analysis, % Oil | Water | Solids | Distribution % Oil | Solids |
|---|---|---|---|---|---|---|---|---|---|---|---|---|---|
| RBT-2 | Sand | 400 | 2550 | 15 | 65.5 | 24.6 | 9.9 | Overflow | 95.8 | 3.8 | 0.4 | 92.9 | 6.3 |
| | | | | | | | | Underflow | 41.3 | 24.7 | 34.0 | 7.1 | 93.7 |
| RBT-3 | Sand | 415 | 2800 | 15 | 64.9 | 25.1 | 10.0 | Overflow | 85.0 | 13.5 | 1.5 | 98.6 | 34.0 |

TABLE 4-continued

| Separation of Solids-Oil-Water Mixtures | | | | | | | | | | | | | |
|---|---|---|---|---|---|---|---|---|---|---|---|---|---|
| | | Temp | Press | Time | Feed Analysis, % | | | | Product Analysis, % | | | Distribution % | |
| Test | Solid | °C. | psi | min | Oil | Water | Solids | Product | Oil | Water | Solids | Oil | Solids |
| | | | | | | | | Underflow | 24.9 | 16.2 | 58.9 | 1.4 | 66.0 |
| RBT-4 | Clay | 400 | 2680 | 15 | 74.0 | 18.6 | 7.4 | Overflow | 98.6 | 0.8 | 0.6 | 99.0 | 18.0 |
| | | | | | | | | Underflow | 25.2 | 9.0 | 65.8 | 1.0 | 82.0 |
| RBT-5 | Clay | 415 | 2670 | 15 | 66.8 | 25.2 | 7.9 | Overflow | 78.7 | 20.4 | 0.9 | 97.6 | 11.2 |
| | | | | | | | | Underflow | 18.6 | 13.6 | 67.8 | 2.4 | 88.8 |

EXAMPLE 5

A low-solids (1.11 percent) oil-water emulsion was prepared by mixing oil from the Huntington Beach area with water. The mixture was treated in an autoclave according to the procedures described in Example 1. The tests conditions and results are presented in Table 5. Product solids content was consistently less than that of the feed.

TABLE 5

| Low-Solids (Oil-Water Emulsion) Tests | | | | | |
|---|---|---|---|---|---|
| Temp. | Press. | Water (%) | | Solids (%) | |
| (°C.) | (psig) | Feed | Product | Feed | Product |
| 400 | 1800 | 16.2 | 3.9 | 1.11 | 0.39 |
| 415 | 3350 | 25.6 | 9.7 | 1.11 | 0.85 |
| 360 | 2250 | 25.6 | 3.4 | 1.11 | 0.58 |

EXAMPLE 6

One untreated froth and one sample of froth treated according to the process of the present invention were contacted with water to simulate separation in a continuous-operation settler. Each sample was poured into a 1500 ml beaker containing 800 ml of 80° C. water. The untreated froth used was froth #2. Upon contact of untreated froth with water, there was substantially no separation of the hydrocarbon phase from the water and/or solids component of the froth. The one sample of froth treated according to the process of the present invention was treated froths from test no. 16. Upon contact with the water in the beaker, the oil and water phases of the treated froths 16 separated substantially instantaneously with the oil phase residing above the water phase. In less than 15 seconds, substantially all the solids had settled to the bottom of the water phase.

EXAMPLE 7

A tar sands froth is passed through a separation process to separate the hydrocarbon fraction. The processing unit is located in a vertical shaft having a depth of about 7,200 ft and a finished casing diameter of 24 in. Suspended in the vertical shaft is the reactor string which consists of two coaxially oriented pipes which comprise a downcomer-riser system. Attached to the bottom of the downcomer-riser system is the reactor which consists of an inner reactor pipe and an outer reactor pipe. The downcomer pipe is a 16 in. pipe 5,000 ft in length. The riser pipe which is located inside the downcomer is 10 in. diameter pipe 5,000 ft in length. The outer reactor pipe has a 20 in. diameter and is 2,000 ft in length. The inner reactor pipe, which is located within the outer reactor pipe, is 2,000 ft in length with a 10 in. diameter. The inner and outer reactor pipes together comprise a reactor volume of 4,360 cubic ft which provides a 15 minute residence time at reaction temperature and pressure with about a 25 weight percent steam and about 2 weight percent gas content.

The froth feed enters the reactor string and travels downward through the annular portion of the coaxial pipe downcomer-riser system. The froth is heated through indirect heat exchange with treated froth which is traveling upward in the center riser pipe. The froth stream is heated to within 50° F. (28° C.) of the treatment temperature before it enters the outer reactor pipe. Supplemental heat is supplied by means of indirect heat exchange with a high-temperature pressure-balance fluid which occupies the void volume surrounding the reactor string. With a 50° F. (28° C.) approach temperature at the hot end of the riser downcomer heat exchanger, the system heat duty is 12.75 million BTU/hr. A heat exchange fluid flow rate of 1,600 gal/min is required to supply this heat duty at a hot fluid-reactor approach temperature of 25° C. The heat transfer fluid is circulated via a 3 in. diameter pipe using a 50 psi high-temperature centrifugal pump. A gas cap is maintained above the heat exchange fluid to provide the primary pressure drive forced to overcome the pressure head. A small air-compressor system is provided for this purpose. A surface gas-fired tube heater rated at 15 million BTU/hr is used to heat the heat exchange fluid.

The feed stream which has been heated to about 375° C. and whose pressure has increased from an inlet pressure of 50 psi to a pressure of 2000 psi enters the outer reactor pipe. The temperature of the stream is increased to a treatment temperature above about 400° C. The pressure is increased to a treatment pressure above about 2000 psi. The stream passes through the outer reactor pipe and into the inner reactor pipe at a flow rate which provides a total reactor residence time of about 15 minutes at a stream feed rate of 10,000 barrels of bitumen per day. As the treated stream passes out of the inner reactor pipe and into the riser pipe, cooling of the treated stream is initiated by heat exchange contact with the incoming froth feed stream. The temperature and pressure of the treated stream decreases as it flows upward from the reactor zone. When the treated stream exits the riser pipe the temperature is about 150° C. and the pressure is about 250 psi.

Upon leaving the reactor system the treated stream is fed into a gravity settler in which the hydrocarbon fraction, comprising less than 1 weight percent solids and less than 5 weight percent water, is separated from the treated stream.

Although the foregoing invention has been described in some detail by way of illustration and example for purposes of clarity and understanding, it will be obvious that certain changes and modifications may be practiced within the scope of the invention, as limited only by the scope of the appended claims.

What is claimed is:

1. A process suitable for separating the hydrocarbon fraction from a fluid stream comprising a tar sands froth comprising:

pressurizing said stream to a treatment pressure above about 1000 psig and heating said stream to a treatment temperature above about 300° C., said pressurizing and heating being effective to produce a treated stream capable of gravity separation of the hydrocarbon fraction;

reducing the pressure on said treated stream to produce a separation pressure which is less than said treatment pressure; and separating said hydrocarbon fraction from said treated stream at said separation pressure.

2. The process of claim 1 wherein said separating step comprises gravitationally settling said treated stream.

3. The process of claim 2 wherein said gravitational settling occurs substantially instantaneously.

4. The process of claim 1 wherein said froth comprises between about 15 weight percent and about 35 weight percent water and between about 65 weight percent and about 85 weight percent hydrocarbons.

5. The process of claim 1 wherein said froth comprises more than about 1 weight percent solids and wherein said separated hydrocarbon fraction comprises less than about 1 weight percent solids.

6. The process of claim 5 wherein said separated hydrocarbon fraction comprises less than about 0.5 weight percent solids.

7. The process of claim 1 further comprising adding a diluent to said treated stream.

8. The process of claim 7 wherein said diluent is added at a treated stream temperature above about 80° C.

9. The process of claim 7 wherein said diluent comprises naphtha.

10. The process of claim 9 wherein sufficient naphtha is added to produce a naphtha to treated stream weight ratio of between about 0.5 and about 1.

11. The process of claim 10 wherein said ratio is between about 0.75 and about 1.

12. The process of claim 1 further comprising conducting said treated stream to said separating step in a substantially laminar flow mode.

13. The process of claim 1 wherein said pressure is produced by the hydrostatic head of a column of said fluid stream.

14. The process of claim 1 further comprising cooling said treated stream.

15. The process of claim 1 wherein said heating step comprises placing said fluid in heat exchange relationship with said treated stream.

16. The process of claim 1 wherein said treatment pressure is between about 1800 psig and about 3700 psig.

17. The process of claim 1 wherein said treatment pressure is between about 2100 psig and 3000 psig.

18. The process of claim 1 wherein said treatment temperature is above about 350° C.

19. The process of claim 1 wherein said treatment temperature is between about 400° C. and about 450° C.

20. The process of claim 1 wherein said treatment temperature is less than about 415° C.

21. The process of claim 1 further comprising maintaining said fluid stream at said treatment temperature and said treatment pressure for a time period between about 1 and about 60 minutes.

22. The process of claim 21 wherein said period is between about 1 minute and about 30 minutes.

23. The process of claim 21 wherein said period is between about 1 minute and about 15 minutes.

24. A process suitable for separating the hydrocarbon fraction from a tar sands froth comprising:

pressurizing a fluid stream comprising a tar sands froth to a treatment pressure between about 1800 psig and 3700 psig and heating said stream to a treatment temperature above about 350° C.;

maintaining said fluid stream at said treatment temperature and said treatment pressure for a time period between about 1 minute and about 30 minutes, said pressurizing and heating being effective to produce a treated stream capable of gravity separation of the hydrocarbon fraction;

reducing the pressure on said treated stream to produce a separation pressure which is less than said treatment pressure;

separating said hydrocarbon fraction from said treated stream at said separation pressure.

25. The process of claim 24 wherein:

said treatment temperature is between about 400° C. and about 450° C.;

said treatment pressure is between about 2100 psig and 3000 psig; and said period is between about 1 minute and about 15 minutes.

26. In a process for extracting hydrocarbon values from tar sands comprising forming a pulp of tar sands with steam, caustic soda and makeup water, subjecting said pulp to a froth flotation operation, removing the froth fraction produced by said froth flotation operation, and recovering hydrocarbons from said froth fraction, the improvement comprising performing said recovering of hydrocarbons by a process comprising:

heating the froth above about 300° C. at a treatment pressure above about 1000 psig, said heating at said treatment pressure being effective to produce a treated froth capable of gravity separation of the hydrocarbon fraction;

reducing the pressure on said treated froth to produce a separation pressure which is less than said treatment pressure; and separating a hydrocarbon fraction from said treated froth at said separation pressure.

27. The process of claim 26 wherein said separating step comprises:

cooling said treated froth to above about 80° C.;

adding diluent to said treated froth;

gravity settling said treated froth to produce a hydrocarbon fraction and a water fraction; and separating said hydrocarbon fraction from said water fraction.

28. The process of claim 27 wherein said diluent is naphtha.

29. The process of claim 26 wherein said froth comprises more than about 1 weight percent solids and wherein said separated hydrocarbon fraction comprises less than about 1 weight percent solids.

30. The process of claim 26 wherein said separating step is a continuous stream process comprising:

contacting said treated froth with a layer of water which comprises a previously separated water fraction of tar sands froth;

gravitationally separating said treated froth into a hydrocarbon fraction and a solids-containing water fraction; and continuously removing said hydrocarbon fraction and said water fraction.

31. The process of claim 26 wherein said pressure is provided by the hydrostatic head of a column of said froth.

32. A process suitable for separating the hydrocarbon fraction from a fluid stream comprising a tar sands froth comprising:

a continuous flow treatment including substantially continuously pressurizing said stream to a treatment pressure above about 1000 psig and heating said stream to a treatment temperature above about 300° C. to produce a treated stream; and separating said hydrocarbon fraction from said treated stream at a pressure less than said treatment pressure.

* * * * *